US005152221A

United States Patent [19]

Weeks

[11] Patent Number: 5,152,221

[45] Date of Patent: Oct. 6, 1992

[54] ANGLED DOCTOR BLADE ARRANGEMENT FOR GRAVURE PRESS

[76] Inventor: John A. Weeks, 36 South Prospect Ave., Plattsburgh, N.Y. 12901

[21] Appl. No.: 681,132

[22] Filed: Apr. 5, 1991

Related U.S. Application Data

[63] Continuation-in-part of Ser. No. 536,538, Jun. 12, 1990, abandoned.

[51] Int. Cl.[5] ..... B41F 3/36

[52] U.S. Cl. ..... 101/157; 101/169

[58] Field of Search ..... 101/155, 157, 161, 167, 101/169; 15/256.5, 256.51, 256.52, 236.01, 236.07, 245; 355/299; 118/261

[56] References Cited

U.S. PATENT DOCUMENTS

| | | | |
|---|---|---|---|
| 2,096,322 | 10/1937 | Crafts | 101/157 |
| 3,361,059 | 1/1968 | Klingler | 101/169 |
| 4,393,775 | 7/1983 | Cappel et al. | 101/155 |
| 4,590,857 | 5/1986 | Dahlgren | 101/350 |
| 5,027,513 | 7/1991 | Allison, Jr. | 101/157 |

FOREIGN PATENT DOCUMENTS

| | | | |
|---|---|---|---|
| 1284973 | 12/1968 | Fed. Rep. of Germany . | |
| 165683 | 8/1985 | Japan | 355/299 |
| 1241554 | 8/1971 | United Kingdom . | |

OTHER PUBLICATIONS

IBM Tech. Disclosure Bulletin vol. 18, No. 6 Nov. 1975 "Roll Scraping Blade".

*Primary Examiner*—Clifford D. Crowder
*Assistant Examiner*—Ren Yan
*Attorney, Agent, or Firm*—Schweitzer Cornman & Gross

[57] ABSTRACT

A doctor blade, for removing excess ink from a gravure cylinder, comprises first and second blade sections formed of flexible metal. The blade sections are joined by a rigid, slotted coupling member so as to lie at a substantial angle to each other. The first blade section contacts an upwardly moving section of the cylinder at an angle of from 65 to 90 degrees. The second blade section is mounted in a cantilever manner to accommodate resilient deflection of the first blade section. The first blade section is thus maintained in substantially uniform pressure contact with the cylinder while at the same time being disposed at a relatively large angle to the surface of the cylinder for optimum doctoring effectiveness.

15 Claims, 1 Drawing Sheet

ANGLED DOCTOR BLADE ARRANGEMENT FOR GRAVURE PRESS

RELATED APPLICATIONS

This application is a continuation-in-part of my earlier application Ser. No. 536,538, filed Jun. 12, 1990, now abandoned.

BACKGROUND AND SUMMARY OF THE INVENTION

The invention relates to improvements in gravure presses and more particularly to improvements in the doctor blade facilities utilized in conjunction with such presses.

In gravure printing, a gravure cylinder is prepared, in which small but defined recesses are provided in the pattern of the image to be printed so that the gravure cylinder has image areas and non-image areas. The gravure cylinder is arranged to cooperate with an impression roll, which forms a pressure nip with the gravure cylinder. A web or sheet of material to be printed passes through the nip, at which time ink, retained in the recesses forming the image areas of the gravure cylinder, is transferred to the surface of the sheet or web.

In accordance with well known practice, printing ink is initially applied to the gravure cylinder, at a point in advance of the transfer nip, over the entire surface of the cylinder. Typically, this may be accomplished by causing the lower portion of the cylinder to operate within an ink pan, with the lower extremities of the gravure cylinder dipping below the surface of the ink in the pan. As the surface of the cylinder emerges from the ink pan, it is fully coated with ink. Thereafter, as the ink-covered surface travels upward, toward the transfer nip, it is wiped by a doctor blade, so that the non-image or-land areas of the cylinder are wiped clean of ink. After passing the doctor blade, the cylinder surface contains ink only in the recesses defining the image area, enabling the ink to be applied to the substrate in accurately predetermined patterns of dots and lines to form the printed image.

As will be readily apparent, quality gravure printing requires that the doctoring operation be performed in a highly effective manner, so that the outer surface (i.e., the non-image areas) of the cylinder is wiped thoroughly clean of ink. Typically, for this purpose, the press is provided with a doctor blade, formed of thin, flat spring steel material, which is mounted to press against the surface of the gravure cylinder a short distance in advance of the transfer nip.

Studies have indicated that for optimal doctoring effectiveness, the doctor blade should be mounted at an angle of about 80° to a tangent line at the point of contact of the doctor blade with the gravure cylinder, the blade making an acute angle with the tangent on the side thereof extending toward the ink supply. Notwithstanding such knowledge, doctor blades are rarely oriented at this optimum angle, because of complications that result from such an orientation. Thus, rarely is there a working gravure press in which the gravure cylinder rotates with perfect trueness. More typically, either the gravure cylinder is slightly eccentric, or the bearings on which the cylinder is mounted introduce eccentricities. In either case, when operating in connection with a doctor blade oriented at the optimum angle of about 80°, it is very difficult for the tip of the doctor blade to properly follow the surface of an even slightly eccentric gravure cylinder. This can result in low quality work and/or excessive wear and damage to the gravure cylinder. Gravure cylinders are, of course, very expensive, so that optimum orientation of the doctor blade, although known to be desirable from a theoretical standpoint, has not been put into practice in commercial gravure printing, except perhaps in most expensive, high precision presses, which are relatively few in number.

Instead, conventional gravure presses orient the doctor blade so as to contact the surface of the gravure cylinder at a relatively low angle, for example in the range of 40–60 to the tangent line at the point of contact. While avoiding the problems experienced when the doctor blade is mounted at the optimum (80°) angle, the conventional (40–60) angle gives rise to problems of a different kind. In particular, when a gravure press is operating at high speed, carrying a layer of ink to a doctor blade disposed at a relatively low angle to the cylinder surface, there is a tendency for the doctor blade to hydroplane on the layer of ink. In order to overcome this tendency, significant pressure must be applied to the doctor blade, to cause it to be pressed tightly against the surface of the gravure cylinder. When the cylinder is operating at full speed, during normal printing operations, the heavy pressure of the blade against the cylinder surface is effectively counteracted by the hydraulic forces of the moving ink layer which is being doctored off of the surface of the cylinder. However, when the press is operating at lower speeds, as it frequently is during shading time, and adjusting, etc., the heavy pressure of the doctor blade against the cylinder surface is not counteracted hydraulically, resulting in excessive wearing of the cylinder.

An earlier proposal for dealing with this problem was to provide a doctor blade formed so that its outer end portion is bent at an angle to the main portion of the blade. The bent outer end portion of the blade is thus angled to contact the surface of the gravure cylinder at a relatively optimum angle, while at the same time the main body of the blade lies at a considerably lower angle to the roller in order to provide a desirable degree of flex in the blade. A blade of this configuration is shown and described in British patent specification No. 1,241,554.

In theory, forming the blade with a bent tip provides an ideal arrangement in that the working edge of the blade is disposed at an optimum angle to the gravure roller, while at the same time there is adequate resilience in the mounting of the blade, resulting from the shallower angle of the main body of the blade, to allow the blade to easily follow eccentricities in the gravure cylinder without excessive wear and/or damage.

While the theory of the bent blade configuration of British patent specification No. 1,241,554 is appealing, it has not, heretofore, proven useful in practice because of incompatibilities of the materials utilized. For example, the standard and preferred hardness of the blade material utilized for the manufacture of doctor blades for this purpose is in the range of 48–52, Rockwell C. Such a material is not capable of being bent at an angle necessary to achieve the objectives of the bent blade concept. Typically, blade material of the prescribed hardness cannot effectively be bent more than about 10 degrees, which is inadequate for the purpose. On the other hand, materials that are of a sufficiently lower hardness to enable the blade tip to be bent at an effective angle to the main body of the blade, for example, at an angle of about 45–60 degrees, are too soft to do an effective job of doctoring the gravure cylinder over an adequate blade working life. Accordingly, notwithstanding that the theoretical advantages of the bent doctor blade have been known, the concept has not achieved any significant level of commercial utilization.

In accordance with the present invention, a novel and improved doctor blade arrangement is provided which effectively enables the desired angular blade configuration to be utilized, while at the same time enabling blade materials of optimum hardness to be employed. This is achieved by constructing the blade, normally a single element, as a three part assembly. This assembly is comprised of an outer or working blade section, which is relatively short and is disposed at an optimum angle to the surface of the gravure roll. A second blade section, which may be referred to as the support section, is arranged at a desired angle, for example 60 degrees, to the working section. The two blade sections are rigidly joined by a coupling section, advantageously formed of a relatively soft, lightweight material, such as aluminum. The individual blade sections can be, and desirably are of a flat form and are rigidly joined in the desired angular relationship by the coupling section.

In accordance with one of the more specific aspects of the invention, the individual blade sections are secured in the coupling section by a resilient gripping arrangement, which not only simplifies and facilitates the assembly procedures, but also, in operation, provides a desirable degree of vibrational damping.

For a more complete understanding of the above and other features and advantages of the invention, reference should be made to the following detailed description of a preferred embodiment and to the accompanying drawings.

DESCRIPTION OF PREFERRED EMBODIMENTS

Figure 1:
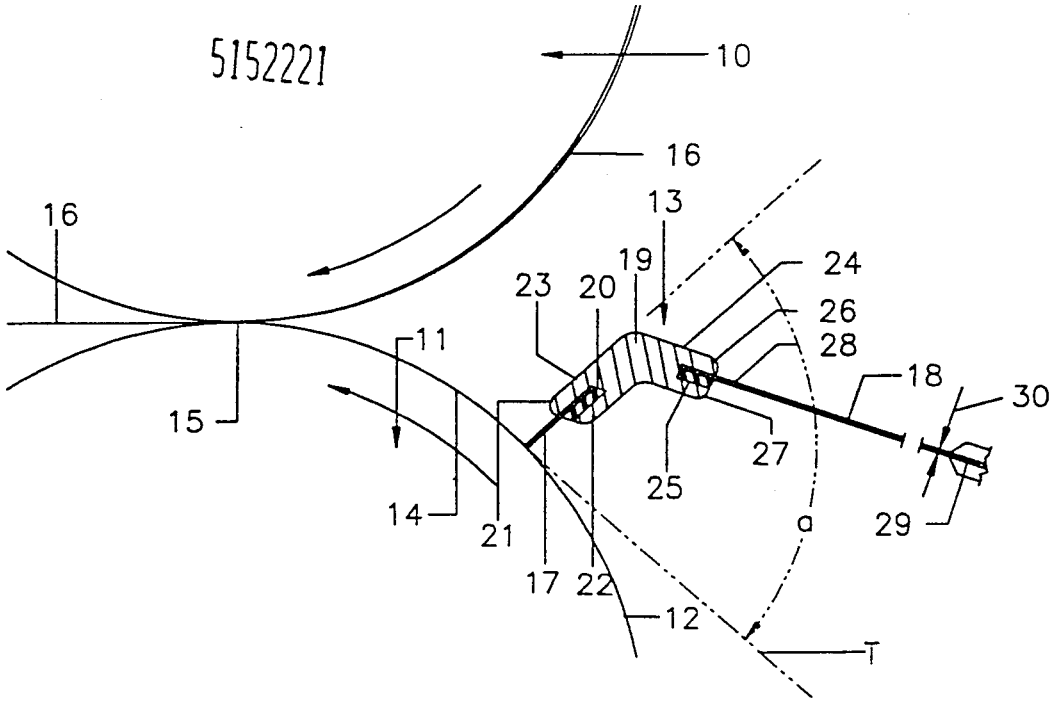
FIG. 1 is a fragmentary cross sectional view illustrating a gravure press arrangement employing a three-part angular blade assembly according to the invention.

Referring now to the drawing, and the reference numerals 10, 11 refer generally to upper and lower cylinders of a gravure press. The press itself may be of well known construction and arranged to function, in general, in a conventional manner. Typically, ink is applied to the lower portion 12 of the lower cylinder in excess of needed quantities. A doctor blade, designated generally by the reference numeral 13 makes full width contact with the surface 14 of the lower gravure cylinder in advance of the transfer nip 15, and serves to wipe from the surface of the cylinder the excess ink, leaving only that amount which is desired for printing. A web 16, of paper or other suitable material to be printed, may be carried to the transfer nip on the surface of the upper cylinder 10. As the web 16 passes through the nip, the ink pattern remaining on the lower cylinder 11 is transferred to the lower surface of the web, all in a well known manner.

The present invention is directed to the construction of the doctor blade 13, and is directed specifically to a novel and improved doctor blade assembly in which a working portion 17 of the blade is arranged to contact the surface of the gravure cylinder at a desirably high angle, preferably less than 90 degrees and greater than 65 degrees, and optimally approximately 80 degrees to the tangent to the surface of the cylinder 12, at the point of contact. In the illustration of FIG. 1, the tangent line is designated by the letter T, and the angle between the plane of the working section 17 of the blade and the tangent line is designated as $\alpha$.

Pursuant to the invention, the blade assembly 13 comprises, in addition to the working blade section 17, a support section 18. A rigid coupling member 19 joins the working and connecting sections 17, 18 respectively at a desired angle, typically about 120–135 degrees. The support section 18 thus lies at a flat angle to the tangent line T, e.g., about 20 degrees. Ideally, an angle of 100 degrees, which places the support section parallel to the tangent T, would be optimum. However, most existing presses would not accommodate such a mounting without structural modification.

At least the working section 17 of the blade is formed of an optimally hardened spring steel blade material, of a Rockwell C hardness in a suitable range, optimally C48–C52. For the purposes of the invention, the working blade section 17 may have a thickness of approximately 8 mils (0.008 inch) and a width of approximately 10 mm. The blade section 17 is received in a slotted recess 20 formed in the coupling member 19, and is clamped tightly between first and second walls 22, 21 respectively of the connecting element, which define the intervening slotted recess 20. In an advantageous embodiment of the invention, the working blade section 17 is received in the recess 20 to a depth of approximately 6 mm, leaving an unsupported projecting portion of about 4 mm. The overall length of the blade section 17 is typically such as to extend across the full face width of the gravure cylinder 11.

In accordance with the invention, the coupling member 19 is in the form of an elongated strip-like section, extending across the full width of the press. Typically and desirably, it is formed of an extruded section of aluminum or other extrudable metal. Although it is within the contemplation of the invention that the connecting element 19 could be fabricated by machining processes, it is most expeditiously and economically produced by extrusion.

As shown in FIG. 1, the coupling member 19 has two integral portions 23, 24 disposed at an angle of about 120–135 degrees. The forward section 23 mounts the working blade 17, while the back section 24 grips and is mounted by the free end of the support section 18 of the blade.

Inasmuch as the support section 18 of the blade is not in contact with the gravure cylinder 12, it may be of a different material than the working section 17. Typically, however, it is formed of hardened spring steel of a similar hardness. In a typical advantageous application, the support blade section 18 may have an overall width of about 3 inches. It may also advantageously be of somewhat greater thickness than the working section of the blade, for example 12 mils (0.012 inch). The outer portion 24 of the coupling member 19 is formed with a slotted recess 25 defined by first and second walls 27, 26 respectively, which grip the outer end 28 of the blade section 18. The opposite end 29 of the support section 18 is suitably mounted on the press, in any conventional manner, typically providing for a limited degree of adjustment toward and away from the gravure roller 11, as symbolically indicated by the arrows 30, in order to control pressure of the working blade section 17 against the surface of the roller.

To particular advantage, the slotted recesses 20, 25 formed in the coupling member 19 are of substantially greater thickness than the thickness of the blades received therein. For example, a thickness of 60 mils (0.060 inch) is advantageous. Two advantages flow from utilizing a slotted recess of thickness greater than that of the blade materials: First, the extrusion operation is greatly simplified and expedited by providing for the slots of increased thickness. As the slot thickness is reduced toward the thickness of the blade material, extrusion requirements become exceptionally difficult to meet. In addition, the arrangement enables the blade sections 17, 18 to be mounted and gripped with the assistance of resilient strip inserts 31, 32 (see FIG. 2). The resilient strips are received in the slotted recesses and extend across the full length thereof. Desirably, the width of the resilient strips 31, 32 is approximately equal to the depth of the slotted recesses 20, 25. As reflected in FIG. 2, for example, after insertion of the resilient strips, the blades are inserted along the outside walls of the slotted recesses, in a manner to be snugly engaged by the then slightly compressed strips. A suitable material for the resilient strips is a 60 durometer rubber. The blade sections are directly supported on one side by the "second" walls 21, 26, with the resilient strips 31, 32 interposed between the blade sections and the "first" walls 22, 27.

Figure 2:
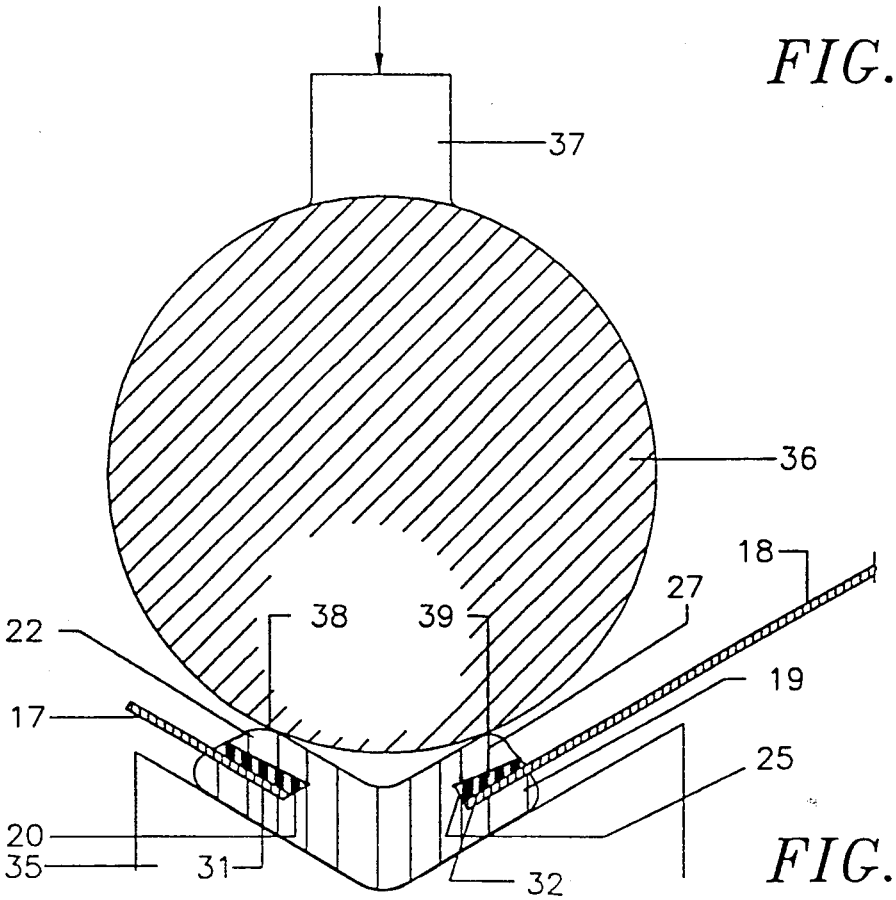
FIG. 2 is an enlarged, fragmentary cross sectional illustration showing the manner of assembly of the three-part blade device of FIG. 1.

To particular advantage, assembly of the blade sections 17, 18 with the connecting element 19 is accomplished with the aid of a compression jig, as reflected in FIG. 2. The jig includes a shallow V-shaped support 35, the contours of which closely match the initial outer contours of the extruded coupling member 19. After careful insertion of the blade sections 17, 18 into their respective slotted recesses 20, 25, along with the resilient strip elements 31, 32, the assembly is placed on the Vee-shaped support element 35, in the manner shown in FIG. 2, providing firm support for the outer or "second" walls 21, 26. A compression element 36, which advantageously may be in the form of an elongated cylindrical pressure bar, suitably rigidified by a support member 37 is pressed downwardly onto the coupling member 19, in the manner shown in FIG. 2. This is accomplished by a suitable hydraulic press or the like (not shown) designed to apply relatively uniform pressure across the full length of the pressure bar 36.

As reflected in FIG. 2, the diameter of the pressure bar 36, or at least the contours of the lower portion thereof contacting the coupling member 19, are such that the pressure bar contacts the coupling member principally at two widely spaced points 38, 39 constituting the outer end portions of the respective "first" walls 22, 27 of the coupling member. Upon the application of sufficient downward pressure at these points, the walls 22, 27 of the coupling member are deformed downwardly. The displacement of the material occurs to a greater extent toward the outer extremities of the respective walls. This causes the slotted recesses 20, 25 to be permanently deformed into a somewhat trapezoidal configuration, compressing and deforming the resilient stripes and tightly and permanently gripping the respective blade sections 17, 18. The accurate alignment of the block sections is not disturbed, because the outer or "second" walls 21, 26 are firmly supported, and only the inner or "first" walls 22, 27 are displaced.

One of the advantages of the described arrangement for joining the blade section to the connecting element 19 is the fact that the resilient strips 31, 32 provide a highly effective damping medium, so that any vibrational characteristics that may be present in the equipment tend to be effectively isolated and not transmitted through to the working blade section, if the vibrations originate elsewhere, and/or quickly attenuated if the vibrations tend to be developed within the working section. The arrangement also makes it very easy to assemble blades using different thickness of blade material, as the resilient strips can easily accommodate a variety of blade thicknesses in slotted recesses of fixed thickness.

The structure of the invention enables the recognized theoretical advantages of the angled blade configuration to be put into practice under realistic conditions of commercial operations. A key to this is the realization that the angled blade configuration cannot be derived effectively by simply bending a single section of blade material to provide a working section disposed at an optimum angle for doctoring, and a support section disposed at a relatively flat angle, optimum for support. Rather, the arrangement of these blade sections is usefully derived by utilizing a three piece structure, in which two blade sections are joined by a rigid coupling member across the full width of the machine. The coupling member is fabricated to have connecting portions disposed at the desired angle, so that the respective blade sections do not have to be bent at all in order to achieve optimal orientation of each. This arrangement has the further advantage that the respective working and support sections of the blade may be of specifically different materials, each optimized for its function. Additional advantages are derived from the vibration isolating characteristics of the coupling member. In part, this results from the mass of the coupling member itself, which is located at a substantial distance from the mounted end of the blade and thus inherently provides a degree of damping of vibrational tendencies. This is in addition to constructing the coupling member to have relatively thick blade-receiving recesses, in which are inserted full length strips of resilient material. These serve not only to tightly and effectively grip the edges of the blade material, but also to help in damping and/or attenuating vibrational tendencies.

A further advantage of the three-part blade structure resides in the fact that irregularities in the blade-mounting facilities of the press, which may appear over time with extended use of the press equipment, are not "telegraphed" to the working end of the blade. With the structure of the invention, the initial assembly of the blade can be carried out under carefully controlled conditions, and the working section 17 of the blade is completely isolated from any physical abnormalities in the mounting mechanism of the press.

It should be understood, of course, that the specific forms of the invention herein illustrated and described are intended to be representative only, as certain changes may be made therein without departing from the clear teaching of the disclosure. Accordingly, reference should be made to the following appended claims in determining the full scope of the invention.

I claim:

1. In a gravure press of the type comprising a gravure cylinder mounted for rotation and cooperating with an impression roll to form a transfer nip in which the image carried by said gravure cylinder is applied to a substrate to be printed, means for coating the entire surface of said gravure cylinder with ink in advance of said transfer nip, and doctor blade means for removing excess ink from the surface of said cylinder in advance of said transfer nip, wherein the doctor blade means comprises first and second blade sections oriented at a large angle to each other whereby the first blade section is oriented at a large angle to and contacts the surface of the gravure cylinder and the second blade section is oriented at a substantially lower angle to the gravure cylinder and mounts said first blade section, the improvement characterized by (a) said first blade section being of generally flat configuration and engaging an upwardly moving portion of the surface of said gravure cylinder at an angle thereto of greater than 65° and less than 90° with respect to a line tangent to said cylinder at the point of contact of said blade section therewith and extending therefrom in a direction opposite to the direction of rotation of said cylinder, (b) said second blade section being separate from said first blade section, being of generally flat configuration, and being oriented at a large angle to said first blade section, (c) said first and second blade sections being formed of thin, flexible metal, (d) a rigid coupling member rigidly joining said first and second blade sections at said large angle, (e) means mounting one end of said second blade section in a cantilever manner to accommodate resilient deflection of the other end thereof toward and away from the surface of said cylinder for maintaining said first blade section resiliently pressed against said cylinder surface with a substantially uniform pressure.

2. A gravure press according to claim 1, further characterized by (a) said first and second blade sections being formed of hardened spring steel, and (b) said first blade section being of less thickness than said second blade section.

3. A gravure press according to claim 1, further characterized by (a) said coupling member having oppositely disposed slotted recesses therein defined by spaced-apart opposed walls for the reception of end portions of said first and second blade sections, (b) said coupling member being formed of a deformable material, and (c) means comprising deformed portions of said spaced-apart walls rigidly mounting said blade sections in said coupling member.

4. A gravure press according to claim 3, further characterized by (a) said slotted recesses initially being of greater thickness than the thickness of said blade sections, and (b) compressible resilient strips received in said recesses and positioned on one side only of the blade sections therein, (c) said resilient strips being elastically compressed by said deformed portions of said spaced-apart walls, whereby said blade sections are rigidly retained in position in said recesses at least in part by the pressure of said elastically compressed strips.

5. A gravure press according to claim 4, further characterized by (a) the slotted recesses in said coupling member are defined by first and second spaced-apart walls, (b) said recesses are partially closed by deformed outer end portions of said first walls projecting toward said second walls, and (c) said resilient strips are placed between said blade sections and said first walls, (d) said blade sections being supported in direct contact with said second walls.

6. A gravure press according to claim 3, further characterized by (a) said coupling member being an extruded metal section.

7. A doctor blade construction specially designed and configured for a gravure press or the like, which comprises (a) first and second blade sections formed of flat, flexible metal, and (b) a coupling member of rigid construction rigidly joining said blade sections at a substantial angle to each other, (c) said coupling member being of extruded metal construction and having formed therein a pair of generally oppositely directed slotted recesses for the reception of the respective blade sections, (d) said slotted recesses being defined by spaced-apart first and second walls, (e) said recesses being of greater thickness than said blade sections, and (f) compressible strips received in said slotted recesses and being maintained under compression between said blade sections and one of said walls, (g) said blade sections being held in rigid contact with said other walls.

8. A doctor blade construction according to claim 7, further characterized by (a) said first blade section being of shorter length than said second blade section and adapted for engagement with the surface of a gravure cylinder and being formed of spring steel material of a hardness substantially in the range of 48–52 Rockwell C.

9. A doctor blade construction according to claim 7, further characterized by (a) said blade sections being inserted in said slotted recesses in direct contact with said second walls, and (b) said first walls having portions deformed to extend toward said second walls and thereby compressing and deforming said resilient strips.

10. A doctor blade construction according to claim 7, further characterized by (a) said first and second blade sections being formed of hardened spring steel, and (b) said first blade section being of lesser thickness than said second blade section.

11. A doctor blade construction according to claim 10, further characterized by (a) said first blade section having a thickness of approximately eight mils and said second blade section having a thickness of approximately 12 mils.

12. A doctor blade construction according to claim 11, further characterized by (a) said first blade section has an overall width of about 10 mm.

13. A doctor blade construction according to claim 7, further characterized by (a) said coupling member having slotted recesses therein for the reception and rigid mounting of said blade sections, (b) said slotted recesses being disposed at an angle to each other of about 100–135°.

14. A doctor blade construction according to claim 13, further characterized by (a) strips of resilient material being inserted in said slotted recesses on one side only of each of said blade sections.

15. A doctor blade construction according to claim 14, further characterized by (a) said strips of resilient material being formed of an elastomeric material of about 60 durometer.

* * * * *